US005896865A

United States Patent [19]

Patel

[11] Patent Number: 5,896,865

[45] Date of Patent: Apr. 27, 1999

[54] FLAMINGO BILL-SHAPED HAIR CLIP

[75] Inventor: Samir Patel, Montebello, Calif.

[73] Assignee: California Clips, Inc., Van Nuys, Calif.

[21] Appl. No.: 08/880,585

[22] Filed: Jun. 23, 1997

[51] Int. Cl.[6] ..... A45D 8/20

[52] U.S. Cl. ..... 132/277

[58] Field of Search ..... 132/277, 273, 132/275, 276, 278, 279, 280, 284, 255; D28/40, 39; 24/510, 455

[56] References Cited

U.S. PATENT DOCUMENTS

| | | | |
|---|---|---|---|
| D. 257,792 | 1/1981 | Chao | D28/40 |
| D. 348,121 | 6/1994 | Park | D28/40 |
| 637,510 | 11/1899 | Holm | 132/280 |
| 1,194,844 | 8/1916 | Kalinowska | 132/275 |
| 1,356,785 | 10/1920 | Patterson | 24/510 |
| 2,201,719 | 5/1940 | Eicher | 132/277 |
| 2,459,926 | 1/1949 | D'Alberto | 132/277 |
| 2,629,915 | 3/1953 | Weiss | 24/510 |

FOREIGN PATENT DOCUMENTS

| | | | |
|---|---|---|---|
| 770291 | 9/1934 | France | 132/277 |
| 777224 | 2/1935 | France | 132/277 |
| 74017 | 9/1949 | Norway | 132/284 |

*Primary Examiner*—Jeffrey A. Smith
*Assistant Examiner*—Eduardo C. Robert
*Attorney, Agent, or Firm*—William L. Chapin

[57] ABSTRACT

A hair clip for gripping strands of a woman's hair arranged in a desired coiffure includes upper and lower tapered jaw pieces having front portions which curve arcuately downwards in a manner suggestive of the jaw parts of a flamingo's bill. The rear portions of the jaw pieces are joined by a transversely disposed pivot pin which permits relative motion of the upper and lower jaw pieces in a vertical plane. A coil spring encircling the pivot pin urges apart the rear portions of the upper and lower jaw pieces, thereby urging the front arcuately downwardly curved portions of the jaw pieces into compressive clamping contact. Preferably, the front portion of the lower jaw piece is shorter and more curved than the front portion of the upper jaw piece, and is received in a longitudinally disposed channel formed in the lower surface of upper jaw piece.

18 Claims, 4 Drawing Sheets

FLAMINGO BILL-SHAPED HAIR CLIP

BACKGROUND OF THE INVENTION

A. Field of the Invention

The present invention relates to articles for securing hair arrangements on the heads of humans. More particularly, the invention relates to a hair clip having a pair of jaws resiliently urged together, for clamping together strands of a woman's hair to maintain a desired coiffure.

B. Description of Background Art

A wide variety of hair clips have been proposed and/or are in use for keeping a woman's hair in aesthetically satisfying and functional arrangements. Typical of such hair clips are those disclosed in the following U.S. Pat. Nos.: Chan, 3,983,887, Oct. 5, 1976, Clip; Yasuda, 4,976,277, Dec. 11, 1990, Hair Clip; Chen, 4,991,607, Feb. 12, 1991, Hairpin; Kuo-Hua, 5,109,878, May 5, 1992, Hairclip; Kuo-Hua, 5,355,899, Oct. 18, 1994, Arched Hairclip; Yasuda, 5,445,170, Aug. 29, 1995, Hair Clip; Healzer et al., D359,144, Jun. 6, 1995, Combined Hair Clip And Garland Retainer.

The following U.S. design patents exemplify a particular type of hair clip which employs upper and lower elongated members that are pivotably joined near the rear ends thereof, the rear ends of the members being urged apart by a spring to cause the inner facing surfaces of the front portions of the jaws to exert a compressive clamping force on hair strands. Thus Park, U.S. Pat. No. D348,121, Jun. 21, 1994, Hair Clip discloses a hair clip of the aforementioned type which has upper and lower jaws, each having a width which is substantially uniform forward of a rear pivot pin joining the jaw pieces. The lower jaw has a slight upwardly convex curvature, while the upper jaw has a long portion having a substantially curved, upwardly convex shape and a short straight front portion. This design limits the effective clamping area of the jaws to a short region rearward of the front ends of the jaws, where the straight portion of the upper jaw contacts the lower jaw. In front elevation view, the contacting areas of the upper and lower jaws have inwardly convex, contacting surfaces.

Kalichlman, U.S. Pat. No. D292,327, Oct. 13, 1987, Hair Clip discloses a clip having upper and lower jaws of substantially uniform plan-view width forward of a pivot joint, with short inwardly tapered front jaw portions. In side elevation view, both upper and lower jaws have approximately the same upwardly convex curvature.

Chao, U.S. Pat. No. D257,792, Jan. 6, 1981, Hair Control Clip discloses a hair clip having upper and lower jaws formed from wire loops, the lower jaw having a uniform width, and the upper jaw having a uniform width substantially narrower than the lower jaw, and slightly longer than the lower jaw. Both upper and lower jaws have a slight upwardly concave curvature.

None of the prior art hair clips known to the present inventor have both a capability for firmly gripping hair strand bundles of widely varying sizes, while still being readily insertible into and removable from a wide variety of coiffures. The present invention was conceived of to provide a hair clip which firmly grips hair strand bundles of various sizes, and which is readily insertable into a coiffure.

OBJECTS OF THE INVENTION

An object of the present invention is to provide a hair clip which has a substantially long hair gripping area.

Another object of the invention is to provide a hair clip comprising a pair of elongated jaws having short rear portions which are pivotably joined together and urged apart by a spring to force the front portions of the jaws into clamping contact with one another, in which at least one of the jaws tapers to a substantially narrow front end, thereby facilitating insertion of the tapered jaw piece into a hair bundle.

Another object of the invention is to provide a hair clip with upper and lower jaws each having a relatively straight rear section, and a downwardly curved front jaw section, thereby providing a substantially long hair clamping region between the upper surface of the curved front lower jaw section and the lower surface of the curved front upper jaw section.

Another object of the invention is to provide a hair clip including a lower jaw having a straight rear section joined to a front section having a continuously convex curvature.

Another object of the invention is to provide a hair clip having a lower jaw that includes a front arcuately curved portion which nests within a recessed area in the lower surface of the upper jaw, thereby securing hair strands therebetween.

Another object of the invention is to provide a hair clip having at least one jaw piece which has a channel-shaped, inwardly concave cross section, the outer edges of the channel forming a hair clamping region with the contacting surface of a mating jaw.

Various other objects and advantages of the present invention, and its most novel features, will become apparent to those skilled in the art by perusing the accompanying specifications, drawings and claims.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a hair clip adapted to clamping together strands of hair on a woman's head, thereby to secure and maintain a selected coiffure.

The hair clip according to the present invention includes upper and lower jaw pieces having in side elevation view a shape suggestive of the upper and lower bill parts of a bird, particularly a flamingo. Thus, the upper jaw piece according to the present invention has a rear portion that has a straight upper edge, and a front portion that has an upper edge which tangentially joins the straight upper edge of the rear upper jaw portion, and which curves arcuately downwards therefrom. The height of the upper jaw piece tapers smoothly from a relatively larger value at the rear transverse end of the upper jaw piece to a relatively small value at the front end or tip of the upper jaw piece. Also, as seen from above the upper jaw piece, the horizontal thickness or depth of the upper jaw piece tapers smoothly from a relatively larger value at the rear transverse end of the upper jaw piece, to a relatively small value at the front end or tip of the jaw piece.

In transverse section, as viewed from its rear transverse end wall, the upper jaw piece has the appearance of an inverted U-shaped channel. The channel shape is maintained from the rear transverse end wall to the front transverse end wall or tip of the upper jaw piece, but tapers in both height and thickness dimension to relatively smaller values at the tip of the jaw piece.

The lower jaw piece of the hair clip according to the present invention is shaped similarly to the upper jaw piece but has a transverse section shaped like an upright rather than inverted U. The lower jaw piece also has an arcuately downwardly curved front portion which is slightly shorter and slightly more sharply curved than the front portion of the upper jaw piece.

The straight rear portions of the upper and lower jaw pieces are joined together by a pivot joint which allows pivotal motion in a vertical plane of the jaw pieces with respect to one another. The pivot joint includes a pair of spaced apart flanges which depend downwardly from the lower edges of the front and rear sides of the upper jaw piece, and a pair of spaced apart flanges which depend upwardly from the upper edges of the front and rear sides of the lower jaw piece. The lower jaw-piece flanges are received between the upper jaw-piece flanges and pivotably joined thereto by a pivot pin which is situated in aligned holes provided through each of the four flanges. The upper and lower jaw pieces are urged apart by a coil spring which encircles the pivot pin, the coil spring having upper and lower tangs which forcibly contact the inner facing channel surfaces of the rear end portions of the upper and lower jaw pieces, respectively.

Outwardly directed forces exerted on the upper and lower jaw pieces by the spring urge the rear portions of the jaw pieces to pivot apart, thereby urging those portions of the jaw pieces forward of the pivot pin to be forced together into clamping engagement. Since the lower jaw piece is shorter and narrower than the upper jaw piece, the front portion of the lower jaw piece fits within the inverted U-shaped channel formed between the front and rear side walls of the upper jaw piece. Also, since the upper surface of the front portion of the lower jaw piece has a curvature similar to that of the lower surface of the upper jaw piece slightly rearward of its tip, a relatively long clamping area is provided between the closed jaw pieces. Clamping pressure on various size hair strand bundles is enhanced by the "nesting" of the lower jaw piece within the upper channel-shaped jaw piece. Moreover, the tapered shape of the lower jaw piece facilitates its insertion into a hair-do.

The channel shapes of the upper and lower jaw pieces gives the jaw pieces substantially greater flexural rigidity per unit weight than they would have if flat. This construction permits the use of a substantially stronger spring, resulting in substantially stronger gripping force achievable with the clip according to the present invention.

DETAILED DESCRIPTION OF THE PREFERRED EMBODIMENTS

FIGS. 1–12 illustrate a flamingo hair clip according to the present invention.

Figure 1:
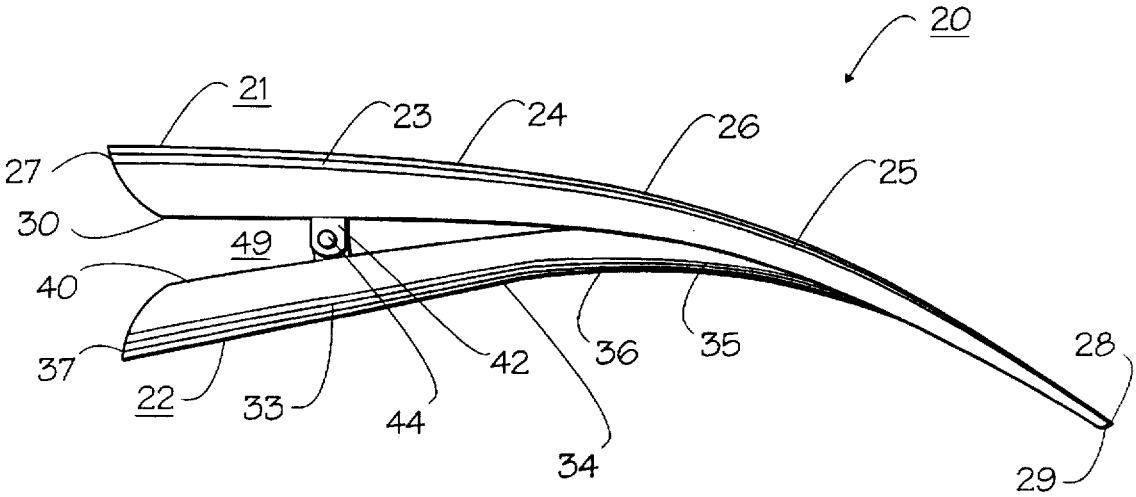
FIG. 1 is a side elevational view of a hair clip according to the present invention.

Referring now to FIGS. 1–6, a basic embodiment of a flamingo hair clip according to the present invention is shown. As shown in FIG. 1, a flamingo hair clip 20 according to the present invention includes a longitudinally elongated, arcuately curved upper jaw piece 21 having a shape suggestive of that of the upper jaw of the bill of a bird such as a flamingo. Hair clip 20 also includes a lower longitudinally elongated, arcuately curved jaw piece 22 shaped somewhat like the lower bill part or jaw of a bird. As shown in FIG. 1, upper jaw piece 21 includes a rear portion 23 having a relatively straight upper edge 24, and a front arcuately curved portion 25 that has an arcuately downwardly curved upper edge 26 which tangentially joins the straight upper edge 24 of rear portion 23. Referring still to FIG. 1, it may be seen that the vertical thickness or height of upper jaw piece 21 tapers smoothly from a relatively larger value at the rear transverse edge wall 27 of the upper jaw piece to a relatively small value at the front transverse edge wall 28 at the tip or beak 29 of clip 20. As may be seen best by referring to FIG. 3, the horizontal thickness or depth of upper jaw piece 21 also tapers smoothly from a relatively large value at the rear transverse edge wall 27 of the upper jaw piece to a relatively small value at the tip 29 of the upper jaw piece.

Figure 2:
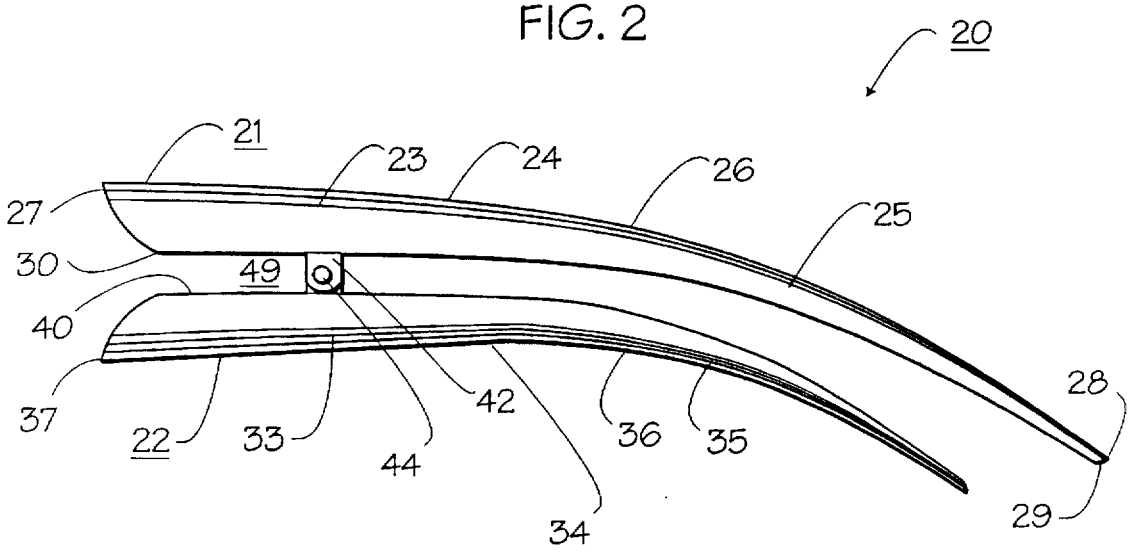
FIG. 2 is a view similar to that of FIG. 1, but showing the jaws of the clip in an open position.
Figure 3:
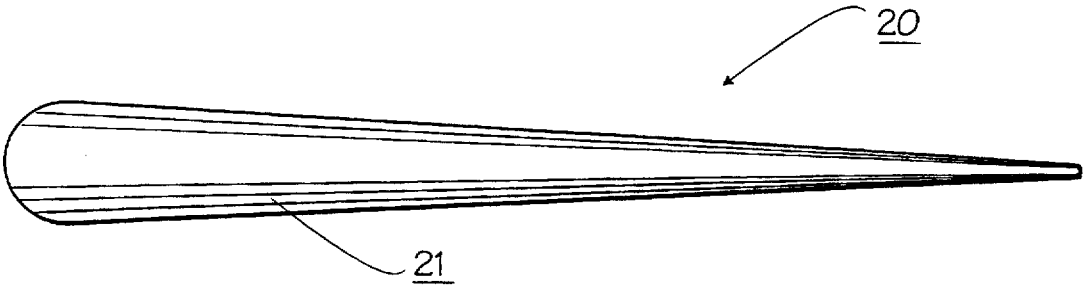
FIG. 3 is an upper plan view of the clip of FIG. 1.
Figure 4:
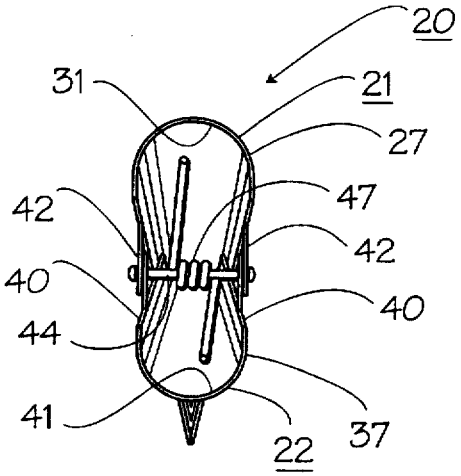
FIG. 4 is a rear elevation view of the clip of FIG. 1.
Figure 6:
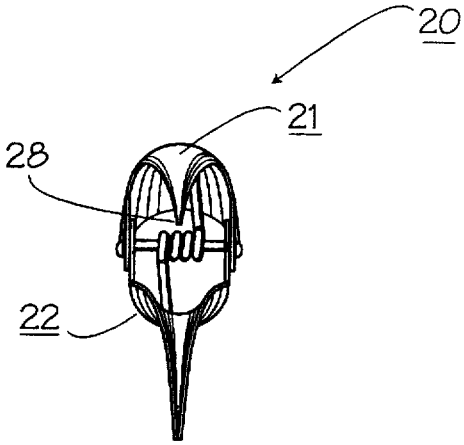
FIG. 6 is a front elevation view of the clip of FIG. 1, with the clip in an opened position.

As may be seen best by referring to FIGS. 2, 4 and 6, the lower longitudinal edge walls 30 of upper jaw piece 21 are curved similarly to that of straight rear portion 24 and front arcuately curved portion 26 of the upper surface of the upper jaw piece. As may be seen by referring to FIG. 5 in conjunction with the foregoing figures, upper jaw piece 21 has a longitudinally disposed inner concave wall surface 31 having the same contour as the upper surface of the upper jaw piece.

Referring now to FIGS. 4 and 6, it may be seen that upper jaw piece 21 has in transverse section the shape of an inverted U-shaped channel, or semi-cylindrical shell having a uniform wall thickness. Thus, upper jaw piece 21 may be and preferably is formed from a piece of sheet metal which is bent about a longitudinal axis to form a tapered semi-cylindrical shell, as shown in FIGS. 4 and 6, and about a transverse axis to bend the shell into a downwardly and arcuately curved shape as shown in FIG. 1.

Referring now to FIGS. 2–6, it may be seen that lower jaw piece 22 has a shape similar to that of upper jaw piece 21. Thus, as shown in FIG. 2, lower jaw piece 22 includes a rear portion 33 having a relatively straight lower edge 34, and a front arcuately curved portion 35 that has an arcuately downwardly curved lower edge 36 which tangentially joins straight lower edge 34 of rear portion 35. Referring still to FIG. 2, it may be seen that the vertical width or height of lower jaw piece 22 tapers smoothly from a relatively larger value at the rear transverse edge wall 37 of the upper jaw piece to a relatively small value at the front transverse edge wall 38 forming the tip of the lower jaw piece. As may be seen best by referring to FIG. 5, the horizontal thickness or depth of lower jaw piece 22 also tapers smoothly from a relatively large value at the rear transverse edge wall 37 of the lower jaw piece to a relatively small value at the tip 38 of the lower jaw piece.

Referring now to FIGS. 4 and 6, it may be seen that lower jaw piece 22 has in transverse section the shape of an upright U-shaped channel, or semi-cylindrical shell having a uniform wall thickness. Thus, lower jaw piece 22 may be and preferably is formed from a piece of sheet metal which is bent about a longitudinal axis to form a tapered semi-cylindrical shell, as shown in FIGS. 4 and 6, and about a transverse axis to bend the shell into a downwardly and arcuately curved shape as shown in FIG. 2.

As may be seen best by referring to FIGS. 2, 4 and 6, the upper longitudinal edge walls 40 of lower jaw piece 22 are curved similarly to that of straight rear portion 34 and front arcuately curved portion 36 of the lower surface of the lower jaw piece. As shown in FIGS. 4 and 6, lower jaw piece 22 has a longitudinally disposed inner concave wall surface 41 having the same contour as the lower surface of the lower jaw piece.

Referring now to FIGS. 1, 2 and 4, upper jaw piece 21 may be sen to include a pair of thin, flat flanges 42 which depend vertically downwardly from opposite lower longitudinal edge walls 30 of the upper jaw piece. Preferably, flanges 42 are integrally formed with upper jaw piece 21, being continuous with a sheet metal preform that is subsequently bent or roll-formed to produce jaw piece 21, as has been described above. Flanges 42 are each provided with a bore 43 for receiving a pivot pin 44, as is described in further detail below.

As shown in FIGS. 1, 2 and 4, lower jaw piece 21 may also be seen to include a pair of thin, flat flanges 45 which depend upwardly from upper longitudinal edge walls 40 of the lower jaw piece. Lower jaw piece flanges 45 are preferably integrally formed with lower jaw piece 22 in the same manner as upper jaw piece flanges 42 of upper jaw piece 21, as described above. As shown in FIG. 2, lower jaw piece flanges 45 preferably have the same size and shape as upper jaw piece flanges 42, and are also provided with pivot pin bores 46 which are horizontally aligned with pivot pin bores 43 of upper jaw piece flanges.

Figure 5:
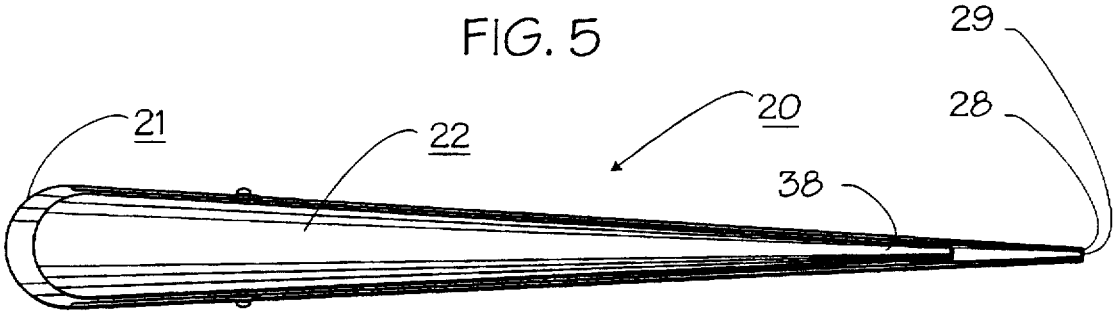
FIG. 5 is a lower plan view of the clip of Figure.

As shown in FIGS. 4 and 5, the horizontal thickness or depth of lower jaw piece 22 is slightly less than that of upper jaw piece 22. This size relationship allows lower jaw piece flanges 45 to be received upwardly between upper jaw piece flanges 42, as shown in FIGS. 2, 4 and 6.

Hair clip 20 includes a helical-coil spring 47 for urging apart rear jaw portions 23 and 33 of upper and lower jaw pieces respectively. Thus, as shown in FIG. 2, with pivot pin bores 43 of upper jaw piece flanges 42 horizontally aligned with pivot pin bores 46 of lower jaw piece flanges 45, coil spring 47 may be positioned between the inner sides of the lower jaw piece flanges, with the coil axis coaxially aligned with pivot pin bores 43 and 46 of the upper and lower jaw piece flanges. Headed pivot pin 44 may then be inserted through the flange bores until the head of the pivot pin contacts an outer wall surface of upper flange 42, whereupon the shank of the pin protrudes outwards through the opposite upper flange 42 and may be peened or otherwise enlarged to retain the pivot pin within the bores.

As may be seen best by referring to FIG. 4, coil spring 47 has at opposite longitudinal ends thereof straight sections or tangs 48 which protrude upwardly and downwardly, respectively, from opposite longitudinal ends of the spring. Upper and lower tangs 48 resiliently contact inner concave surfaces 31 and 41 of the rear portion of upper and lower jaw pieces 21 and 22, respectively, urging the rear portions of the jaw piece apart, as shown in FIGS. 1 and 4. Since the outwardly directed forces exerted by spring 47 on upper and lower jaw pieces 21 and 22 are applied rearwards of the axis of pivot pin 44, those forces cause front jaw-piece portions 25 and 35 to be urged together into clamping engagement.

Figure 7:
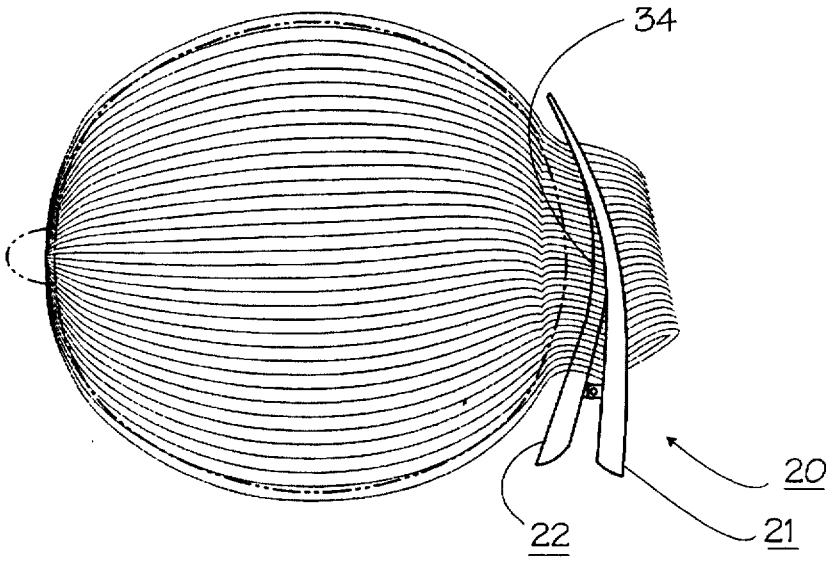
FIG. 7 is a perspective view of the clip of FIG. 1, showing the clip in a generally horizontally oriented position on a person's head.
Figure 8:
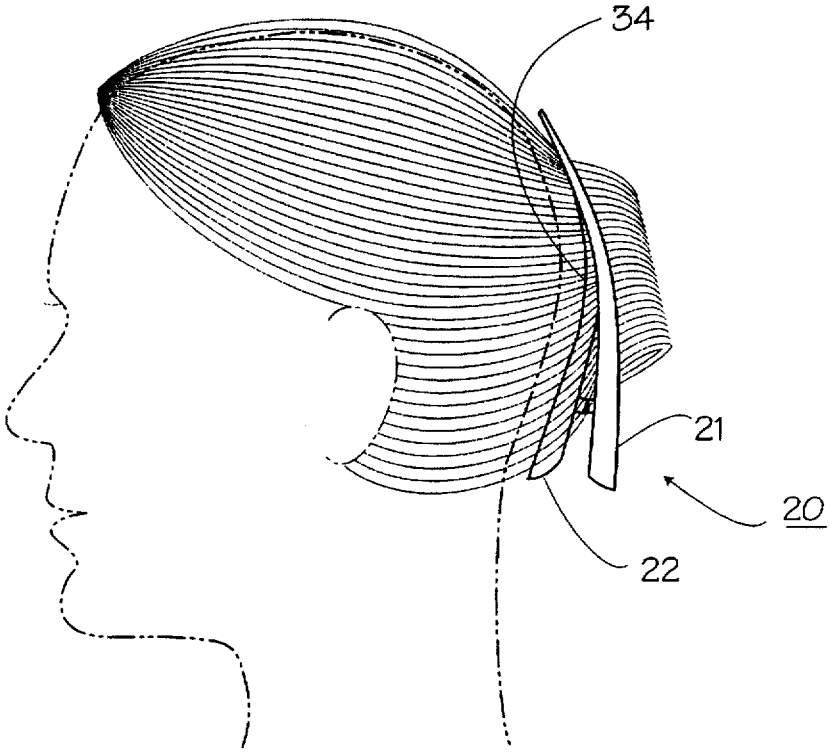
FIG. 8 is another perspective view of the clip of FIG. 1, showing the clip in a generally vertically oriented position on a person's head.

As shown in FIG. 1, the axis of pivot pin 44 is located a substantial distance away from facing longitudinal edge walls 30 and 40 of upper and lower jaw pieces 21 and 22, respectively. This arrangement results in the formation of a substantially large triangular or wedge-shaped spacing 49 between the longitudinal edges of the rear portions of the upper and lower jaw pieces. The substantial vertical spacing between rear ends of the jaw pieces allows the rear ends of the jaws to be squeezed a substantial distance closer together, thereby displacing the front portions of the jaw pieces a substantial distance apart, as shown in FIG. 2. This large displacement facilitates insertion of front portion 35 of lower jaw piece 22 into a hairdo, as shown in FIGS. 7 and 8. Furthermore, as shown in FIGS. 2, 5 and 6, the tapered shape of lower jaw piece 22 also facilitates its insertion to and removal from a hairdo or coiffure.

As may be seen best by referring to FIG. 2, lower jaw piece 22 is more sharply curved than upper jaw piece 21. Thus, as shown in FIG. 2, with clip 20 in an open position in which straight longitudinal edges 30 and 40 of the upper and lower jaw pieces are parallel, front portion 35 of the lower jaw piece angles downwardly away from front portion 25 of the upper jaw piece. With the upper and lower jaw pieces having different curvatures as described, a substantial length of the upper edges of front portion 35 of lower jaw piece 22 contacts inner concave surface 31 of front portion 25 of upper jaw piece 21, with clip 20 in a closed position, as shown in FIG. 1. This substantial length provides a long effective clamping region for hair strand bundles of varying sizes.

Referring now to FIG. 5, it may be understood that, with hair clip 20 in a closed position, as shown in FIG. 1, both upper longitudinal edges 40 of front curved portion 35 of lower jaw piece 22 contact concave inner surface 31 of upper jaw piece 21. This construction advantageously clamps hair strands passed between the jaw pieces at two different points.

FIGS. 7 and 8 illustrate how hair clip 20 may be used to hold strands of hair together to maintain a selected coiffure. As shown in FIG. 7, with clip 20 disposed with its longitudinal axis in a generally horizontal position, concave lower surface 34 of clip 20 conforms approximately to the convex plan view shape of a person's head. As shown in FIG. 8, with clip 20 in a generally vertically oriented position, lower concave surface 34 of clip 20 conforms approximately to the convex elevation view shape of a person's head.

Figure 9:
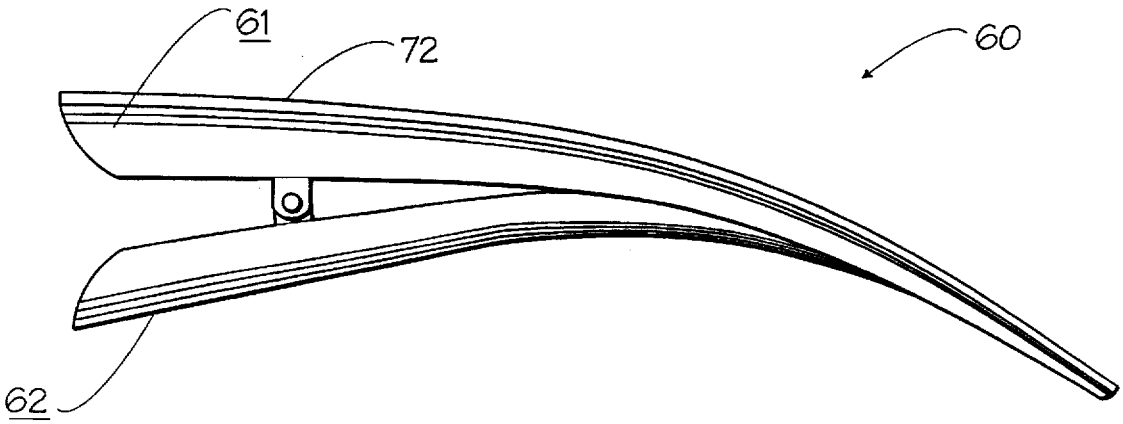
FIG. 9 is a side elevation view of an alternate embodiment of the clip of FIG. 1.
Figure 10:
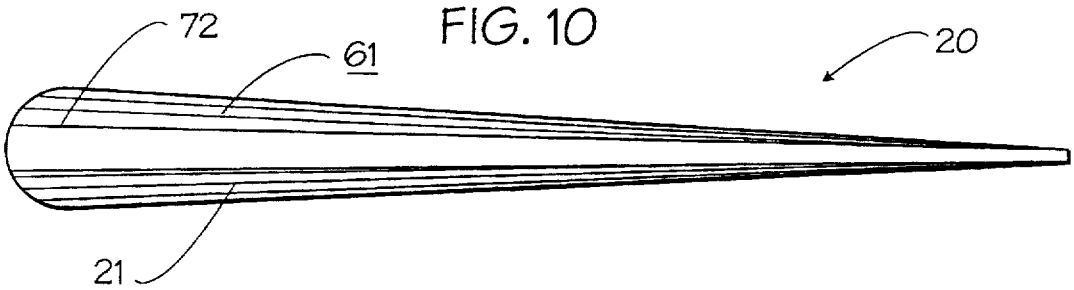
FIG. 10 is an upper plan view of the clip of FIG. 9.
Figure 11:
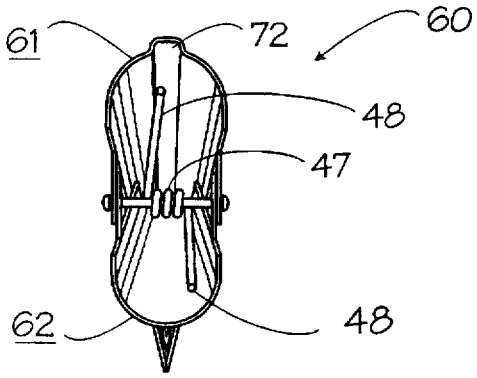
FIG. 11 is a rear elevation view of the clip of FIG. 9.
Figure 12:
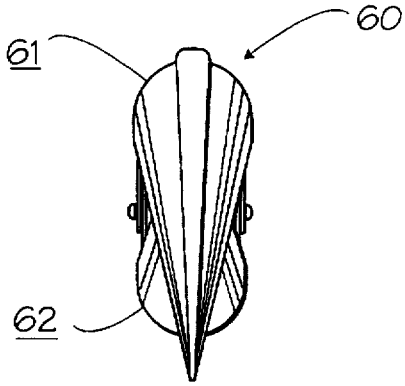
FIG. 12 is a front elevation view of the clip of FIG. 9.

FIGS. 9–12 illustrate an alternate embodiment of a flamingo hair clip according to the present invention. The embodiment 60 shown in FIGS. 9–12 is substantially similar in structure and function to the basic embodiment 20 shown in FIGS. 1–8 and described above. Thus embodiment 60 has upper and lower jaw pieces 61 and 62, respectively, shaped similarly to upper and lower jaw pieces 21 and 22 of embodiment 20 shown in FIGS. 1–8. However, as shown in FIGS. 9 and 10, upper jaw piece 61 has formed in the upper wall surface thereof a longitudinally disposed, upwardly protruding rib 72 which spans the length of the upper jaw piece. As may be seen best by referring to FIGS. 10–12, rib 72 has a generally rectangularly-shaped cross section, and tapers both in height and width from relatively larger values at the rear end of clip 60 to relatively smaller values at the tip of the clip. As may be seen best by referring to FIG. 11, the inner concave surface of rib 72 may receive tang 88 of coil spring 87.

Other modifications of the Flamingo Hair Clip according to the present invention may be made which are within the scope of the invention. Thus, the lower jaw piece of the clip may have a uniform height and/or width, provided that it has a downwardly curved front longitudinal portion. Also, the upper jaw piece of the clip may have a uniform height and/or width, and may even be straight.

What is claimed is:

1. A hair clip for clamping attachment to strands of hair on a human's head comprising:

a. a first, upper longitudinally elongated jaw piece including a rear longitudinal portion having a rear transversely disposed end wall, and a generally straight lower longitudinal surface, an intermediate longitudinal portion having a generally straight lower longitudinal surface, and a front longitudinal portion having a concave, arcuately curved lower longitudinal surface, and a front transverse end wall, b. a second, lower longitudinally elongated jaw piece including a rear longitudinal portion having a rear transversely disposed end wall and a generally straight upper longitudinal surface, an intermediate longitudinal portion having a generally straight upper surface, and a front longitudinal portion having an upper longitudinal surface which angles downwardly from said intermediate longitudinal portion, c. pivot means joining said rear portions of said upper and lower jaw pieces, said pivot means having a transversely disposed pivot axis and providing a capability for pivotal motion in a vertical plane of said upper and lower jaw pieces relative to one another, said pivot means being located forward of the said transverse end walls of said rear longitudinal portions of said upper and lower jaw pieces and holding said rear longitudinal portions of said jaw pieces in a vertically spaced apart relationship forming a space approximating that of a triangle having a vertically disposed base proximate said rear transverse end walls of said rear longitudinal portion of said upper and lower jaw pieces, a generally longitudinally disposed altitude and a vertex proximate the intersection of said front and intermediate longitudinal portions of said lower jaw pieces, and d. spring means for resiliently urging apart those portions of said upper and lower jaw pieces rearward of said pivot axis whereby said upper surface of said downwardly angled front portion of said lower jaw piece and said lower surface of said front portion of said upper jaw piece are urged into contact with each other, and whereby said upper and lower longitudinal surfaces of said intermediate longitudinal portions of said upper and lower jaw pieces are maintained in a forwardly converging disposition effective in clamping hair strands, even with said front portions of said upper and lower jaw pieces displaced vertically from said contact.

2. The hair clip of claim 1 wherein said front portion of said upper jaw piece is further defined as being angled downward from said rear portion of said upper jaw piece.

3. The hair clip of claim 1 wherein said front portion of said upper jaw piece is further defined as being angled arcuately downwards from said rear portion of said upper jaw piece.

4. The hair clip of claim 1 wherein said front portion of said lower jaw piece is further defined as being arcuately downwardly curved.

5. The hair clip of claim 4 wherein the curvature of said front portion of said lower jaw piece is further defined as being greater than the curvature of said front portion of upper jaw piece.

6. The hair clip of claim 1 wherein said pivot means is further defined as comprising in combination;

a. a pair of opposed upper plate-like flanges depending downwardly from opposite lower longitudinal edges of said upper jaw piece, each of said upper flanges having through its thickness dimension a pivot pin bore horizontally aligned with that of the opposed one of said upper flanges, b. a pair of opposed lower plate-like flanges depending upwardly from opposite upper longitudinal edges of said lower jaw piece, each of said lower flanges having through its thickness dimension a pivot pin bore horizontally aligned with said pivot pin bores of said upper flanges, and c. a transversely disposed pivot rotatably received through all four of said upper and lower flange bores.

7. The hair clip of claim 6 wherein said spring means is further defined as being a helical coil spring coaxially mounted over said pivot pin between said upper and lower flanges, said coil spring having at opposite longitudinal ends thereof a pair of radially rearwardly disposed, upper and lower straight sections or tangs which forcibly contact a lower surface of said upper jaw piece and an upper surface of said lower jaw piece, respectively.

8. The hair clip of claim 1 wherein said lower jaw piece is further defined as tapering from a relatively larger rear height at said rear transverse end wall of said lower jaw piece to a relatively smaller height at said front transverse end wall of said lower jaw piece.

9. The hair clip of claim 8 wherein said lower jaw piece is further defined as tapering from a relatively large rear thickness at said rear transverse edge wall of said lower jaw piece to a relatively smaller thickness at said front transverse end of said lower jaw piece.

10. The hair clip of claim 1 wherein said front portion of said upper jaw piece is further defined as having a concave lower surface adapted to conformally receive said front portion of said lower jaw piece.

11. The hair clip of claim 10 wherein said upper jaw piece is further defined as having in transverse section the shape of an inverted U-shaped channel.

12. The hair clip of claim 11 wherein said lower jaw piece is further defined as having in the transverse section the shape of an upright U-shaped channel.

13. A hair clip for gripping hair on a human's head comprising;

a. a first, upper longitudinally elongated jaw piece including a rear longitudinal portion having a rear transversely disposed end wall and a generally straight lower longitudinal surface, an intermediate longitudinal portion having a generally straight lower longitudinal surface, and an arcuately downwardly curved front longitudinal portion having an arcuately downwardly curved lower longitudinal surface, b. a second, lower longitudinally elongated jaw piece including a rear longitudinal portion having a rear transversely disposed end wall and a generally straight upper longitudinal surface, an intermediate longitudinal portion having a generally straight upper surface, and an arcuately downwardly curved front longitudinal portion having an arcuately downwardly curved upper longitudinally disposed surface, said upper jaw piece having in transverse section the shape of an inverted U-shape channel of sufficient width to receive at least a portion of said front longitudinal portion of said lower jaw piece, c. pivot means joining said rear portions of said upper and lower jaw pieces, said pivot means having a transversely disposed pivot axis and enabling pivotal motion in a vertical plane of said upper and lower jaw pieces relative to one another, said pivot means being forward of said rear transverse end walls of said rear longitudinal portions of said upper and lower jaw pieces and holding said portions of said jaw pieces in a vertically spaced apart relationship forming a space approximating that of a triangle having a vertically disposed base proximate said rear transverse end walls of said rear longitudinal portions of said upper and lower jaw pieces, a generally longitudinally disposed altitude and a vertex proximate the intersection of said front and intermediate longitudinal portions of said lower jaw piece, and d. spring means for resiliently urging apart those portions of said upper and lower law pieces rearward of said pivot axis whereby at least a portion of an upper surface of said channel of said arcuately downwardly curved upper jaw piece and at least a portion of said upper arcuately, downwardly curved upper longitudinally disposed surface of said lower jaw piece are urged into compressive contact with one another, whereby said upper and lower longitudinal surfaces of said intermediate longitudinal portions of said upper and lower jaw pieces are maintained in a forwardly converging disposition effective in clamping hair strands, and whereby said curved upper surface of laid front longitudinal portion of said lower jaw piece is maintained partially within said channel, even with said front portions of said upper and lower jaw pieces displaced vertically from said compressive contact, thereby to grip strands of hair located between said surfaces.

14. The hair clip of claim 13 wherein the front transverse end of said upper jaw piece extends forward of said front transverse end of said lower jaw piece.

15. The hair clip of claim 13 wherein said upper jaw piece is further defined as having approximately the shape of a semi-cylindrical shell of generally uniform wall thickness having in transverse section the shape of an inverted U-shaped channel.

16. The hair clip of claim 13 wherein said lower jaw piece is further defined as having approximately the shape of a semi-cylindrical shell of generally uniform wall thickness having in transverse section the shape of a U-shaped channel.

17. The hair clip of claim 15 wherein said lower jaw piece is further defined as tapering in both height and thickness from larger values at the rear end thereof to smaller respective values at the front end thereof.

18. The hair clip of claim 16 wherein said upper jaw piece is further defined as tapering in both height and thickness from larger values at the rear end thereof to smaller respective values at the front end thereof.

* * * * *